US006282753B1

(12) United States Patent
Hochmuth

(10) Patent No.: US 6,282,753 B1
(45) Date of Patent: Sep. 4, 2001

(54) EASY MAINTENANCE FLUSH MOUNT DOOR HANDLE

(75) Inventor: Harold Hochmuth, Paw Paw, MI (US)

(73) Assignee: Special Lite, Inc., Decatur, MI (US)

( * ) Notice: Subject to any disclaimer, the term of this patent is extended or adjusted under 35 U.S.C. 154(b) by 0 days.

(21) Appl. No.: 09/338,678

(22) Filed: Jun. 23, 1999

Related U.S. Application Data

(60) Provisional application No. 60/090,534, filed on Jun. 24, 1998.

(51) Int. Cl.[7] ..... A47B 95/02
(52) U.S. Cl. ..... 16/412; 16/413; 312/348.6
(58) Field of Search ..... 16/412, 413, 422, 16/415; 312/348.6

(56) References Cited

U.S. PATENT DOCUMENTS

D. 303,621 * 9/1989 Russell et al. ..... D8/313
D. 386,962 * 12/1997 Greener ..... D8/313
1,304,700 * 5/1919 Otte ..... 16/412
2,783,494 * 3/1957 Sterling et al. ..... 16/412
3,873,151 * 3/1975 Morris et al. ..... 297/14
4,153,314 * 5/1979 Prater ..... 312/348.6 X
4,586,762 * 5/1986 Kennedy et al. ..... 16/412 X
4,732,430 * 3/1988 Byrns ..... 312/330.1
5,355,554 * 10/1994 Magoon ..... 16/412
5,706,554 * 1/1998 Rückert et al. ..... 16/412
5,743,575 * 4/1998 McFarland ..... 292/336.3
5,921,645 * 7/1999 Lapi ..... 312/245
5,927,836 * 7/1999 Herr et al. ..... 16/412 X

* cited by examiner

*Primary Examiner*—Robert J. Sandy
*Assistant Examiner*—Mark Williams
(74) *Attorney, Agent, or Firm*—Knechtel, Demeur & Samlan

(57) ABSTRACT

A flush mount door handle recessed within a door frame. The door handle is set in a box type configuration. The door handle has a bottom support member that extends at an obtuse angle from the back wall and a pull member that does not come in contact the bottom support member. This type of flush mount door handle is designed to permit runoff of liquids, loose dirt, and grime and allow easier cleaning of the entire door handle.

14 Claims, 3 Drawing Sheets

EASY MAINTENANCE FLUSH MOUNT DOOR HANDLE

This patent application claims the benefit of U.S. Provisional Patent Application, Ser. No. 60/090,534, entitled "Easy Maintenance Flush Mount Door Handle", filed on Jun. 24, 1998.

I. FIELD OF THE INVENTION

The present invention relates to door handles and, more particularly, to a flush mount door handle having easy cleaning properties which make it uniquely suited for use in environments having high germ counts or where germ transmission is to be avoided, for example, hospitals, schools, restaurants, and 3-A sanitary applications.

II. BACKGROUND OF THE INVENTION AND DESCRIPTION OF THE PRIOR ART

The majority of door handles consist of knobs, or arms, or similar shapes and configurations that extend perpendicularly several inches from the exterior of the door for easy grasping and manipulation. In many settings, however, it is not desirable or safe to have door handles protruding into a given space. To address this problem, flush mounted door handles have been introduced.

Typically, flush mount door handles are of a box type configuration having a back wall, a top support member, a bottom support member, and two sidewalls, each perpendicularly extending outwardly from the back wall to form a box with an opening in the front. Within the front opening is a pull member or ridge providing the user a grasping means for manipulation of the handle. The pull member is typically located along the outer edge of one of the sidewalls and extends from the top support member to the bottom support member. The entire unit is mounted to a door by recessing it into the door.

A shortcoming of the current flush mount door handle design is that it creates an environment conducive to unsanitary conditions. The bottom support member creates a flat horizontal surface as it extends perpendicularly, 90°, from the back wall and the pull member creates a "blind" pocket between the back wall and the pull member. This combination makes it difficult to clean the door handle and creates an environment conducive to dirt and grime build up and perhaps, most importantly, germ growth.

There is a need, therefore, for a flush mount door handle that is easy to clean and reduces the buildup of dirt, grime, debris, and pathogenic agents that can cause contamination or the transfer of illness.

III. OBJECTS OF THE INVENTION

It is a primary object of the present invention to provide a flush mount door handle which is easy to keep sanitary.

It is another object of the present invention to provide a flush mount door handle which eliminates the buildup of dirt and grime, and germ growth associated with current flush mount door handles. A related object of the present invention is to decrease the amount of illness caused by contamination that results from using door handles.

It is yet another object of the present invention to provide a flush mount door handle which is economical and easy to install.

Other objects of the present invention will become more apparent to persons having ordinary skill in the art to which the present invention pertains from the following description taken in conjunction with the accompanying drawings.

IV. SUMMARY OF THE INVENTION

The above objects of the present invention are provided for in a sanitary pull flush mount door handle. According to the invention, a flush mount door handle in a box type configuration recessed within the door frame is provided. The improved door handle comprises a back wall, a top support member, a bottom support member, two sidewalls, and a pull member.

The top support member and two sidewalls are each attached to the back wall as is custom in the industry. The bottom support member is attached to the back wall at an obtuse angle sufficient to permit the runoff of liquids and loose dirt and grime. The pull member is affixed to the "box" created by the top support member, sidewalls, and back wall in such a manner that it does not contact the bottom support member, thereby creating a gap which does not interfere with runoff, permits easier cleaning of the entire door handle, and improves air flow behind the pull member.

V. BRIEF DESCRIPTION OF THE DRAWINGS

The Description of the Preferred Embodiment will be better understood with reference to the following figures.

VI. DETAILED DESCRIPTION OF THE PREFERRED EMBODIMENT

Figure 1:
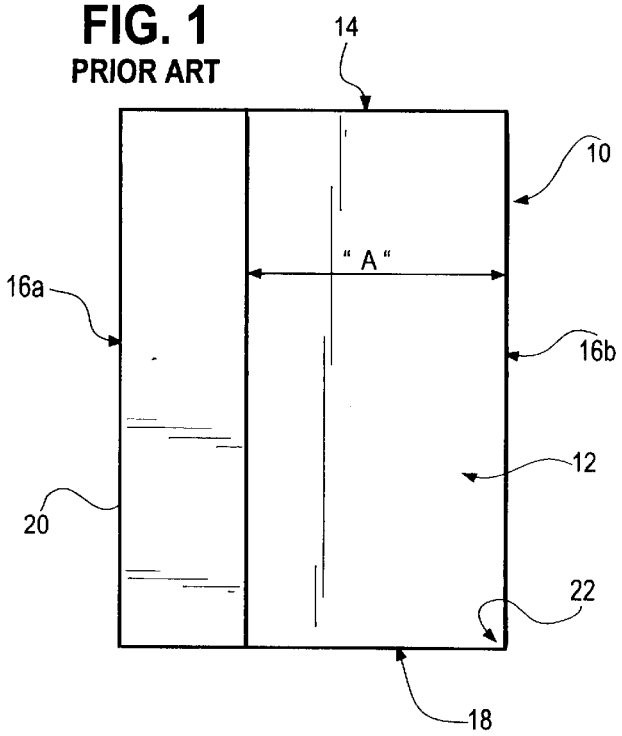
FIG. 1 PRIOR ART
FIG. 1 is a front view of a prior art handle illustrating the 90° position of the bottom support member and the pull member extending from the top support member to the bottom member.

Turning first to FIG. 1, a representative example of a typical flush mount door handle 10 is depicted. As can be seen, door handle 10 has a back wall 12, a top support member 14, two sidewalls 16*a*, 16*b*, a bottom support member 18, and a pull member 20. Top support member 14, sidewalls 16*a*, 16*b*, and bottom support member 18 protrude perpendicularly from the outer edge (not seen) of back wall 12. This configuration creates a box which is then recess mounted to a flush position in a door (See FIG. 5). Pull member 20 is affixed to the outermost edges of a portion of the horizontal length of top support member 14 and bottom support member 18, and along the entire vertical length of either sidewall 16*a* or sidewall 16*b* such that it is essentially flush with the outer surface of the door. A space (not shown) is created between the pull member 20 and the back wall 12 which approximates the width of sidewalls 16*a*, 16*b*, and the top and bottom support members. In this fashion, pull member 20 creates a grip for use in opening a door. In use, a user places a hand into open space "A", grabs pull member 20, and exerts door opening pressure on door handle 10.

As illustrated in FIG. 1, bottom support member 18 protrudes from back wall 12 at a 90° angle, thus permitting debris to accumulate at the upper surface 22 of bottom support member 18. In addition, pull member 20 creates a blind pocket between itself and back wall 12. This creates an area in which dirt, grime, and other debris can accumulate and disease causing agents such as bacteria and viruses can thrive. Such a design makes it time consuming, difficult, and, often, impossible to thoroughly clean door handle 10.

Figure 2:
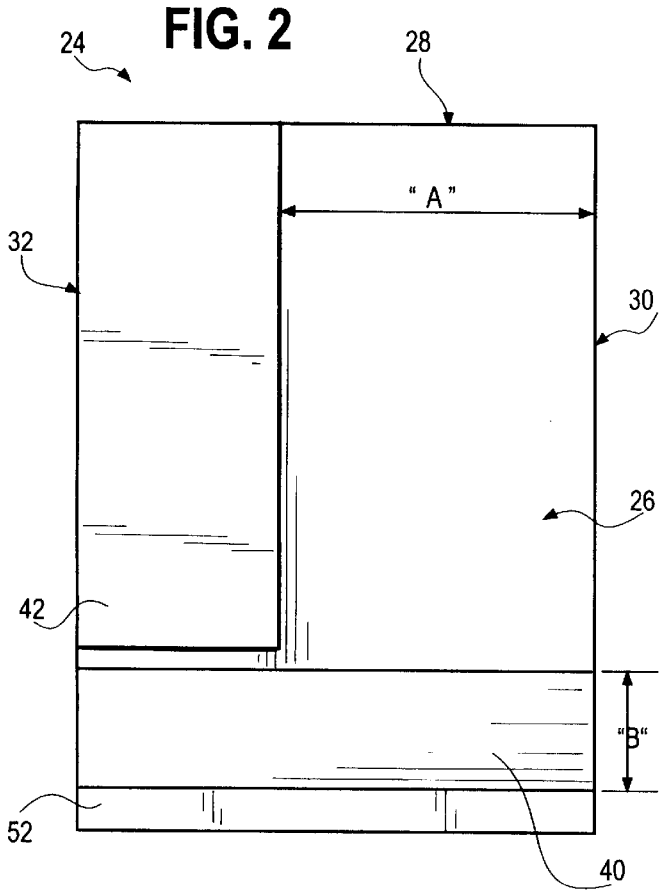
FIG. 2 is a front view of applicant's invention showing the door handle illustrating the obtuse angle position of the bottom support member in relation to the back wall and the location of the pull member in its functional position.

Turning to FIG. 2, a front view of the inventor's improved door handle 24 is depicted. Like present flush mount door handles, the inventive door handle 24 has a back wall 26 surrounded by a top support member 28 and sidewalls 30 and 32. Unlike current door handles, however, in the preferred embodiment, sidewalls 30, 32 extend beyond the length of back wall identified as shown in "B" in FIGS. 2 and 3. Sidewalls 30, 32 taper at an angle 34 (See FIG. 3) beginning at the point where back wall 26 ends 36 and extends to point 38 near the front 41 of door handle 24. Bottom piece 40 is configured to be joined to back wall 26 and follow the angle line of sidewalls 30, 32. Thus, an obtuse angle is created in relationship to back wall 26 enabling debris, dirt, grime, liquid, etc. to run off of door handle 24 without interference. While the preferred embodiment is described with a multipiece construction, those skilled in the arts will quickly understand that alternate embodiments can be manufactured without circumventing the scope and spirit of the inventive device. For a non-limiting example, the back wall, top support member, sidewalls, and bottom support member could be molded as a single piece. Alternatively, the various pieces cold be molded in any combination and number of parts.

Additionally, the sidewalls could also have alternate configurations. For non-limiting example, the sidewalls could extend beyond the length of the back wall and not taper; the bottom piece could be set within the open span of the sidewalls at an obtuse angle with reference to the back wall. The sidewalls could end at the same point as the back wall and the bottom piece contained sidewall portions.

The point being that the manufacture of the part could be undertaken several ways. It is important, however, that the bottom support member be set at an obtuse angle in relation to the back wall. The inventor has found that 135° works well (creating a 45° off vertical); but, again, any obtuse angle is workable.

In the preferred embodiment, pull member 42 is affixed to door handle 24, top support member 28, and to a portion of sidewall 32. Pull member 42 is affixed to the outer edge 44 of top support member 28 and sidewall 32 so as to create a gap between pull member interior surface 46 and the interior surface 48 of back wall 26. As in conventional designs, pull member 42 only extends over a portion of the horizontal length of top support member 28 so as to create open space "A" in the handle. Unlike conventional designs, however, pull member 42 does not extend to meet bottom support member 40. Instead, pull member 42 terminates at a point above bottom support member 40 so that no interference is created for runoff. Additionally, the gap created permits easy cleaning and increased air flow behind pull member 42, an important consideration in minimizing pathogenic agent growth.

Figure 6:
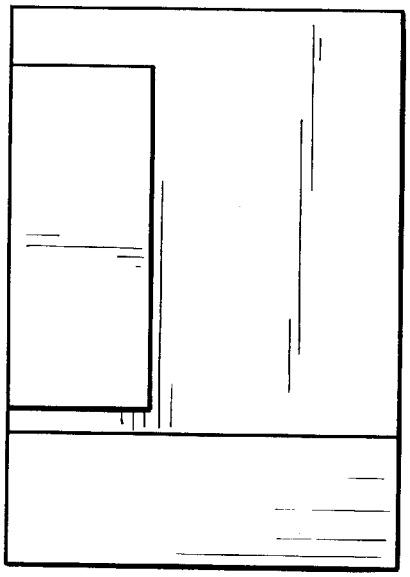
FIG. 6 is a front view illustrating an alternate embodiment of the inventive device depicting the pull member attached to one of the sidewalls.
Figure 7:
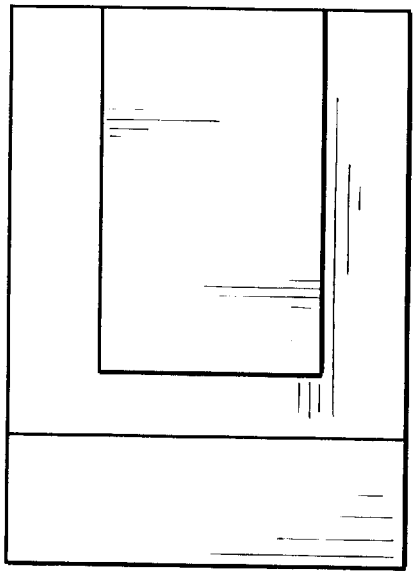
FIG. 7 is a front view illustrating an alternate embodiment of the inventive device depicting the pull member attached to the top support member in a vertical orientation.
Figure 8:
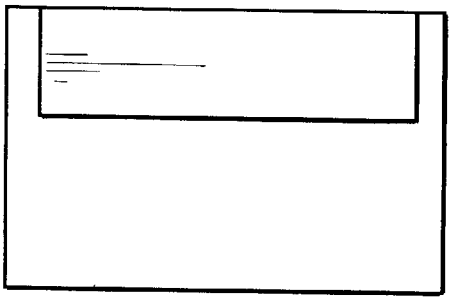
FIG. 8 is a front view illustrating an alternate embodiment of the inventive device depicting the pull member attached to the top support member in a horizontal orientation.
Figure 9:
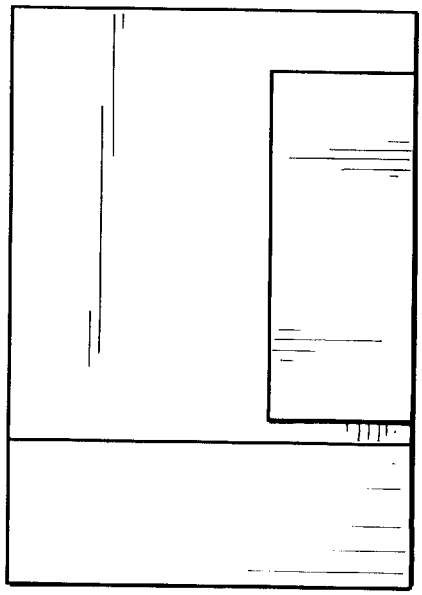
FIG. 9 is a front view illustrating an alternate embodiment of the inventive device depicting the pull member attached to the other sidewall.

While the preferred embodiment places pull member 42 in the conventional setting along sidewall 32, as illustrated in FIGS. 6–8 it can be placed anywhere. The important consideration is that it does not obstruct or interfere with bottom support member 42. A secondary consideration is that it permit increased air flow; although it is contemplated that in some configurations pull member 42 may extend from sidewall to sidewall. The preferred embodiment is manufactured of extruded aluminum, but may be made of any type of material including, but not limited to, metals or plastic using any conventional manufacturing method.

Figure 3:
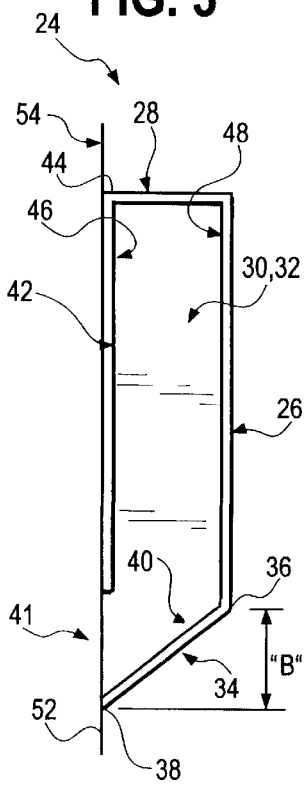
FIG. 3 is a side cut away view of the inventive door handle illustrating the features of the Device.
Figure 5:
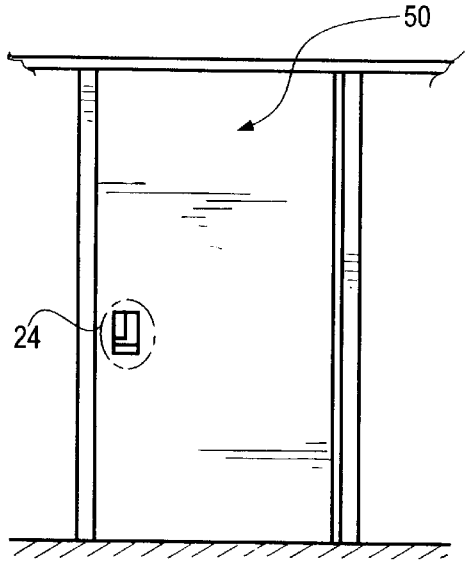
FIG. 5 is a front view of the of the door handle positioned within a door.

Turning to FIG. 3, the component parts of door handle 24 are more clearly illustrated. As is seen, back wall 26, top support member 28, bottom support member 40, and pull member 42 are each approximately the same thickness. Back wall 26 is attached perpendicularly or 90° to top support member 28 and at an obtuse angle 34 to bottom support member 40. These three components along with the sidewalls 30, 32 are proximally received into door 50 (FIG. 5). Door 50 holds the door handle 24 in position such that the door handle 24 is restricted from any rotation within door 50. Additionally, bottom piece 40 can have an extension 52 (FIG. 3) and the top support member 28 has an inlet 54 (FIG. 3) that combine to hold door handle 24 in position within door 50 when the pull member 42 is being pulled by the user. Pull member 42 is attached perpendicularly or 90° to top support member 28. Pull member 42 is also fitted with a ledge 55. Ledge 55 is located at the open end of pull member 42 and extends the full vertical length of pull member 42. Ledge 55 provides the user with a structure tailored toward facilitating an easier means for addressing pull member 42.

Figure 4:
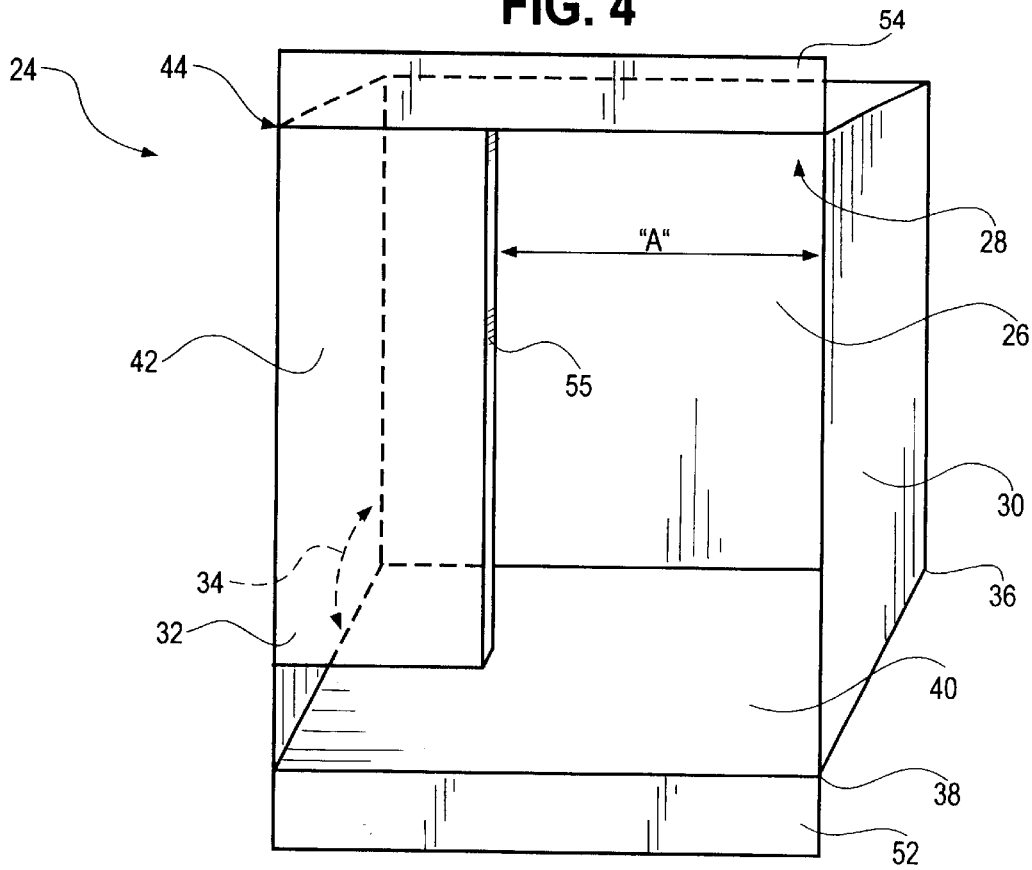
FIG. 4 is a front perspective view of the door handle illustrating the relationship between the various components of the inventive door.

Turning to FIG. 4, a perspective view illustrates the spacial relationships between the various component parts of door handle 24. Obtuse angle 34 serves to prevent germs, bacteria, and unhealthy elements from collecting and being trapped on the bottom support member 40. Obtuse angle 34 also allows gravity to take effect and remove loose elements and liquids that otherwise would remain on bottom support member 40 as the air circulates.

While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the invention.

What is claimed is:

1. A flush mount door handle, comprising:

a back wall having a top edge, a bottom edge, a first side edge and a second side edge, and further defining a front surface and a back surface;

a top support member affixed to the top edge of the back wall, the top support member extending outwardly from the front surface of the back wall;

a bottom support member affixed to the bottom edge of the back wall, the bottom support member extending outwardly from the front surface of the back wall at an obtuse angle to the back wall;

a first side wall and a second side wall, each side wall having a front end and a back end, the back end of the first side wall affixed to the first side edge of the back wall and the back end of the second side wall affixed to the second side edge of the back wall, the first side wall and the second side wall extending outwardly from the front surface of the back wall; and a pull member affixed to an outer edge of the top support member and to the front end of one of the side walls opposite the back wall creating a gap between the back wall and the pull member that extends substantially the length of the side wall, the pull member extending along the front end of the side wall to a position prior to engagement with the bottom support member forming a space between the pull member and the bottom support member for preventing the accumulation of dirt and pathogenic agents and thereby inhibiting germ growth.

2. The flush mount door handle of claim 1 wherein the pull member is affixed to the second side wall.

3. The flush mount door handle of claim 1 further comprising an inlet extending outwardly from the top support member in a direction opposite the bottom support member.

4. The flush mount door handle of claim 3 wherein the inlet extends perpendicularly from the top support member.

5. The flush mount door handle of claim 1 further comprising an extension extending outwardly from the bottom support member in a direction opposite the top support member.

6. The flush mount door handle of claim 5 wherein the extension extends from the bottom support member parallel to the back wall.

7. A flush mount door handle, comprising:

a box having a back wall, a top, a bottom, a first side and a second side, and the back wall further defining a front surface and a back surface;

the top and bottom are each affixed at opposite ends of the back wall and adjacent to the first side and the second side, the first side and the second side are each affixed at opposite ends of the back wall, the bottom affixed at an obtuse angle to the front surface of the back wall; and a pull member having a top edge, a bottom edge, and two side edges, with one of the side edges of the pull member being affixed to an outer edge of the support member and to one of the side walls of the box opposite the back wall, the pull member being affixed along the one of the side walls with the bottom edge of the pull member terminating in a position opposite the obtuse angle located between the bottom and the front surface of the back wall, the position of the pull member forming a space between the pull member and the front surface of the back wall, a gap between the pull member and the other side wall of the box, and an opening between the bottom edge of the pull member and the bottom of the box and which extends along the entire length of the bottom of the box.

8. The flush mount door handle of claim 7 wherein the first side and the second side extend perpendicularly from the back wall.

9. The flush mount door handle of claim 7 wherein the pull member is positioned on the second side to permit a spacing between the pull member and the front surface of the back wall.

10. The flush mount door handle of claim 7 further comprising an inlet extending outwardly from the top in a direction opposite the bottom.

11. The flush mount door handle of claim 10 wherein the inlet extends perpendicularly from the top.

12. The flush mount door handle of claim 7 further comprising an extension extending outwardly from the bottom in a direction opposite the top.

13. The flush mount door handle of claim 12 wherein the extension extends from the bottom parallel to the back wall.

14. The flush mount door handle of claim 1 wherein the pull member is affixed to the first side wall.

* * * * *